United States Patent [19]

Donnelly

[11] 4,320,626

[45] Mar. 23, 1982

[54] PORTABLE BEVERAGE CHILLER/WARMER

[75] Inventor: Joseph H. Donnelly, Warrington, Pa.

[73] Assignee: Fogel Commercial Refrigerator Company, Philadelphia, Pa.

[21] Appl. No.: 149,212

[22] Filed: May 12, 1980

[51] Int. Cl.[3] ..... F25B 21/02; B67D 5/62

[52] U.S. Cl. ..... 62/3; 62/394

[58] Field of Search ..... 62/3, 394, 457, 448, 62/449

[56] References Cited

U.S. PATENT DOCUMENTS

| | | | |
|---|---|---|---|
| 3,008,300 | 11/1961 | Ryan et al. | 62/394 X |
| 3,012,418 | 12/1961 | Hill | 62/457 |
| 3,048,020 | 8/1962 | Jones | 62/3 |
| 3,146,600 | 9/1964 | Cox | 62/3 |
| 3,176,472 | 4/1965 | Cox | 62/3 |
| 3,194,023 | 7/1965 | Sudmeier | 62/3 |
| 3,310,953 | 3/1967 | Rait | 62/3 |
| 3,314,242 | 4/1967 | Lefferts | 62/3 |
| 3,324,667 | 6/1967 | Muller | 62/3 |
| 3,605,421 | 9/1971 | Patrick | 62/394 X |
| 3,821,881 | 7/1974 | Harkias | 62/3 |
| 3,823,567 | 7/1974 | Corini | 62/3 |
| 4,007,600 | 2/1977 | Simms | 62/3 |
| 4,089,184 | 5/1978 | Beitner | 62/3 |
| 4,107,934 | 8/1978 | Beitner | 62/3 |

OTHER PUBLICATIONS

M.E.L.C.O.R.—*The Amazing New Portable Refrigerator,* Publication (4/11/80), 2 sheets.

A & E Systems—*Iceless-Thermo-electric Solid State Iceboxes*-2 pages dtd, 4/11/80.

Koolatron Industries-*Solid State Built-In Refrig. Makes Your Icebox Obsolete*—2 pages-dtd, 4/9/80.

Koolatron Industries-*Portable Refrigeration Price Breakthrough*—1 page-dtd, 1/1980.

*Operating Instructions and Ser. Manual for MT-50--MAGIC TEMP*—Jordon/Fogel Refrig. Co.-2 pages dtd, 7/28/78.

Life Industrial Co., "CHILLWARMER", 3 pages dtd-4/11/80.

*Primary Examiner*—Lloyd L. King

*Attorney, Agent, or Firm*—Caesar, Rivise, Bernstein & Cohen, Ltd.

[57] ABSTRACT

A portable container for cooling or heating liquids stored therein. The container comprises a hollow body and a releasably secureable lid assembly therefor. The container body includes a threaded mouth onto which the lid assembly is secured to seal liquids within the container body. The lid assembly includes thermoelectric chiller/warmer means having thermally conductive immersion means extending downward from the lid for immersion within the liquid in the container body, Peltier type thermoelectric means in intimate thermal engagement with the thermally conductive immersion means and with heat dissipating means. An electrical means for connecting the thermoelectric means to a source of direct current and for enabling the polarity of the direct current provided to the thermoelectric means to be reversed so that the thermally conductive immersion means can either heat or cool the liquid disposed within the container body.

6 Claims, 3 Drawing Figures

PORTABLE BEVERAGE CHILLER/WARMER

This invention relates generally to refrigeration/heating apparatus and more particularly to portable beverage keeping containers including thermoelectric means for heating or cooling liquids therein.

The various devices have been disclosed in the patent literature and various devices are commercially available utilizing thermoelectric means in storage containers for maintaining foods in a hot or cool condition. Examples of such prior art devices are found in U.S. Pat. Nos.: 3,012,418 (Hill, 2nd), 3,048,020 (Jones), 3,194,023 (Sudmeier), 3,310,953 (Rait), 3,314,242 (Lefferts), 3,324,667 (Muller), 3,821,881 (Harkias), 3,823,567 (Corini), 4,007,600 (Sims), 4,089,184 (Beitner) and 4,107,934 (Bitner). Portable thermoelectric refrigeration and/or heating containers are available commercially from Melcor of Trenton, New Jersey, under the trademark FRIGITOTE, from A & E Systems of Santa Anna California under the trademark AE-ICELESS, from Koolatron Industries, Ltd. of Batavia, New York under the trademark KOOLATRON and from Jordon/Fogel Refrigeration Company, of Philadelphia, Pennsylvania, the assignee of the instant invention under the trademark MAGIC-TEMP.

While prior art portable thermoelectric storage containers are suitable for their intended purposes, they are of limited utility inasmuch as they require specially constructed bodies housing the thermoelectric units in the walls or a door thereof.

The patent literature also includes various disclosures of thermoelectric heating and/or cooling devices utilizing thermally conductive immersion element. Examples of such prior art devices are found in U.S. Pat. Nos. 3,146,600 (Cox) and 3,176,472 (Cox).

While the thermoelectric immersion devices disclosed in the patent literature appear effective for quickly refrigerating liquids in which the heating element is immersed, such devices are not suitable for use as a portable storage container for holding heated or cooled liquids.

Accordingly, it is the general object of the instant invention to provide a portable container for heating or cooling the liquids therein and which overcomes the disadvantages of the prior art.

It is a further object of the instant invention to provide a portable container utilizing thermoelectric means and an immersion element for heating or cooling a liquid within the container.

It is still a further object of the instant invention to provide a portable container having a releasably secureable lid thereon wherein the lid includes an immersion element which is heated or cooled by thermoelectric means.

It is still a further object of the instant invention to provide a portable container for heating or cooling liquids which is simple in construction and low in cost.

It is yet a further object of this invention to provide a thermoelectric heating/cooling assembly in the form of a closure for sealing this mouth of a conventional portable liquid storage container and for heating or cooling the liquid contents of said container.

These and other objects of the instant invention are achieved by providing a portable storage container for heating or cooling liquids therein. The container comprises a hollow body for holding the liquid therein and a releasably secureable lid assembly. The body includes a mouth. The lid assembly is arranged to seal the liquid within the container. The lid assembly includes a housing, first thermally conductive immersion means extending downward from the lid substantially the full depth of the container for immersion in the liquid held therein, thermoelectric means of the Peltier type and second thermally conductive means. The thermoelectric means includes a pair of thermal surfaces, one of which being in intimate thermal engagement with said first thermally conductive immersion means and the other of said surfaces being in intimate thermal engagement with the said second thermally conductive means. Electrical means are provided for connecting the thermoelectric means to a source of direct current and for enabling the polarity of said current to be reversed to said thermoelectric means so that said immersion element can either heat or cool the liquid in which it is immersed.

Other objects and many of the attendant advantages of the instant invention will be readily appreciated as the same becomes better understood by reference to the following detailed description when considered in connection with the accompanying drawing wherein.

Figures 1, 2:
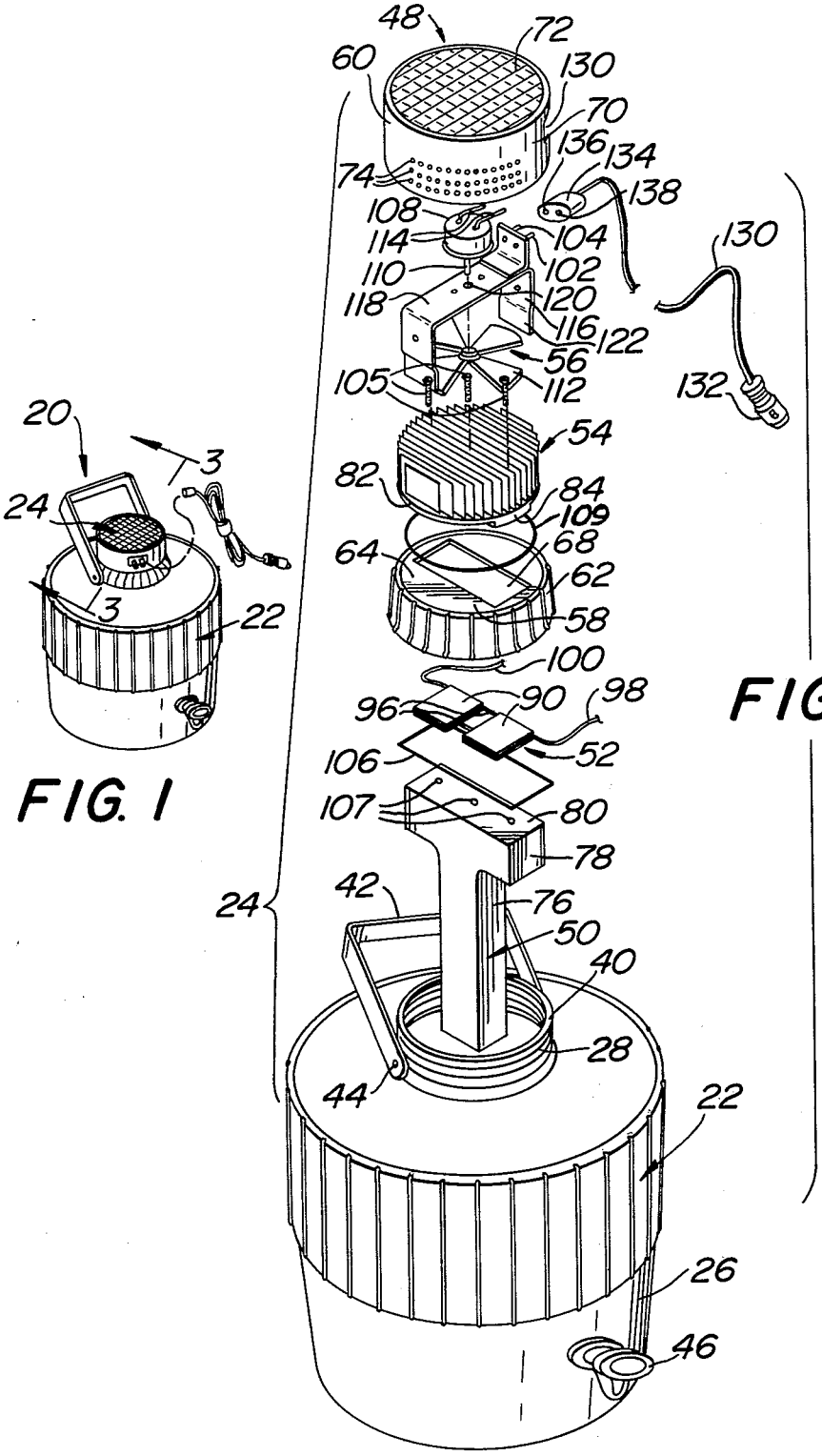
FIG. 1 is an isometric view of the portable thermoelectric chiller/warmer device construced in accordance with the instant invention.
FIG. 2 is an enlarged exploded isometric view of the device shown in FIG. 1.

Referring now in greater detail to the various figures of the drawing wherein like reference characters refer to like parts, there is shown generally at 20 a portable chiller/warmer container constructed in accordance with the instant invention. The unit 20 basically comprises a hollow storage container or vessel 22 and a thermoelectric chiller/warmer lid assembly 24.

The container 22 is of conventional construction and may take any suitable form so long as it includes a hollow interior suitable for holding foodstuffs, e.g., liquids, therein and an open mouth for access to the interior of the container. The drawing of this application shows a picnic-type jug, but such a construction is merely exemplary.

Figure 3:
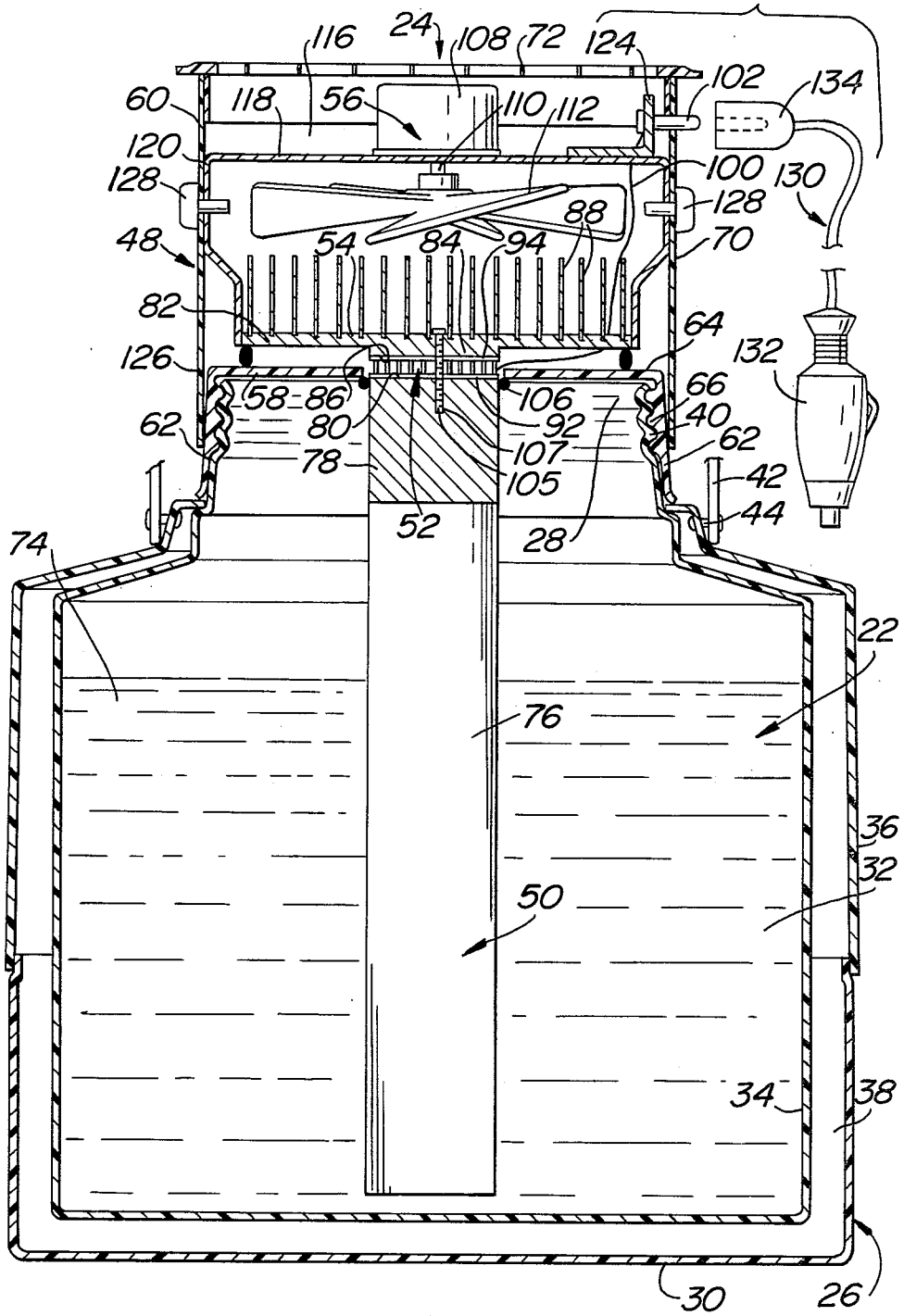
FIG. 3 is an enlarged sectional view taken along line 3—3 of FIG. 1.

Before describing the details of the chiller/warmer lid assembly 24, a description of the construction of the jug 22 is in order. To that end, as can be seen in FIGS. 2 and 3, the jug 22 comprises a hollow body having a cylindrical sidewall 26, terminating at its upper end in a reduced diameter open neck 28 forming the mouth of the jug, and a flat bottom wall 30. The sidewall 26 and bottom wall 30 define a liquid receiving cavity 32 and are formed of an inner wall portion 34 and outer wall portion 36. The wall portions are spaced from each other by an insulating air space 38. The neck 28 of the jug 22 includes plural helical threads 40 extending about the periphery of its outer surface. The threads serve as means for enabling the lid assembly of this invention to be secured to the mouth of the jug to seal the liquid contents within cavity 32. The jug 22 also includes a carrying handle 42, in the form of a U-shaped strap which is secured to the neck of the jug, via respective pins or rivets 44.

In accordance with conventional practice, the container 22 is preferrably formed of a thermally insulating, impact resistant and rugged material, such as plastic.

A spigot or tap 46 is mounted through the sidewall 26 of the jug adjacent the bottom wall thereof. The spigot is arranged to dispense liquid from the interior 32 of the jug.

The chiller/warmer lid assembly 24 of this invention basically comprises a housing 48, first thermally conductive immersion means 50, Peltier type thermoelectric means 52, second.

The top surface 80 of the immersion element 50 is planar and serves as a thermal contact surface for engagement with the thermoelectric means 52 so that heat can be transferred across the interface to either cool or heat the element 50, as will be described later.

The second thermal conductive means 54 basically comprises a disk-shaped member 82 formed of a good thermally conductive material e.g., aluminum. The member has a planar base adapted for disposition on the top surface of the lid 58 and a rectangular projection 84 extending downward from the base through the rectangular opening 68 in the lid. The bottom surface 86 of the projection 84 serves a thermal contact surface for engagement with the thermoelectric means 52 so that heat can be transferred across the interface to either heat or cool the member 82. A plurality of parallel fins 88 project upward from the base of member 54 to expedite heat transfer to or from the ambient atmosphere.

The thermoelectric means 52 is sandwiched between the immersion element 50 and the member 54 to transfer heat therebetween and comprises a pair of solid state modules 90. Each module is a conventional Peltier-type, solid state theremoelectric couple having an opposed pair of thermal surfaces 92 and 94. The modules are connected in series with each other via electrical conductors 96. When direct electric current of one polarity is provided to the serially connected modules one surface, e.g., 92, of each module heats up while the other surface, e.g., 94, cools down. When the polarity of the current is reversed, the opposite surface, 94, heats up and surface 92 cools down. Direct current is provided to the serially connected modules via electrical conductors 98 and 100. Each conductor terminates at a respective electrical connector prong 102 and 104 for engagement with a mating electrical plug (to be described later).

As shown clearly in FIG. 2, the modules 70 are disposed between the thermal contact surfaces 80 and 86 of members 50 and 54, respectively, so that thermal surface 80 of the immersion means is in good thermal transfer contact with the surface 92 of each module while surface 86 is in good thermal transfer contact with surface 94 of each module. To that end, plural screws 105 extend through openings (not shown) in the finned member and into threaded holes 107 in the immersion element. Tightening of the screws assembles the components into the desired thermal engagement.

In order to preclude liquid from leaking out of the lid assembly a rectangular sealing gasket 106 extends about the periphery of the rectangular opening 68 in the lid 58 on the underside thereof. A circular O-ring 109 is interposed between the planar portion 64 of the lid and the underside of member 54.

The fan assembly 56 basically comprises a small electric motor 108 having an output shaft 110 onto which a fan blade 112 is mounted. The motor is arranged to operate off of the direct current provided via conductors 114 connected to connector prongs 102 and 104. The fan motor 108 is mounted on a cross piece 118 of a bracket 116 so that the fan blade 112 is located directly over the fins 88 of heat transfer member 54. The cross piece 118 includes a hole 120 through which the motor shaft extends. The blade is mounted on the motor under the bracket cross piece directly over the fins. The bracket also includes a pair of mounting legs 122 projecting downward for securement to opposed sides of the thermally conductive member 54.

The electric conductor prongs 102 and 104 are mounted on a small flanged bracket 124 on the bracket 116.

The cover 50 is disposed over the fan assembly with its peripheral edge 126 tightly engaging the periphery of sidewall 62 of the lid 58. The cover 50 is secured in place via a pair of threaded fasteners 128 extending through aligned openings in the cover and in the bracket legs 122.

The sidewall 70 of the cover 60 includes an opening through which the prongs 102 and 104 extend for connection to a suitable connector for providing direct current to the device.

In accordance with a preferred aspect of this invention direct current is provided to the unit via a conventional cord set 130. To that end one end of the cord set includes a conventional plug 132 for disposition within a cigarette lighter socket in an automobile or any other suitably configured socket providing direct current. The other end of the cord set 130 includes a female receptacle 134 having a pair of openings 136 and 138 for receipt of the prongs 102 and 104.

It must be pointed out at this juncture that other means for providing direct current to the thermoelectric elements can be provided in lieu of the means shown herein. To that end the device 20 can include rectifier means to provide direct current to the means 50 from an alternating current power source, e.g., a household receptacle. Moreover, the motor need not be provided by the direct current provided to the thermoelectric means 50 but can be independently powered by either a.c. or d.c., as desired.

Operation of the device is as follows:

When the receptacle 134 is engaged so that prongs 102 and 104 extend into openings 136 and 138, respectively, and the plug 132 is inserted into a d.c. receptacle (not shown), direct current of one polarity is provided, via the conductors 98 and 100, to the thermoelectric modules. This action causes heat to be transferred from the module surfaces 92 to the module surfaces 94. Since the immersion member 50 is in intimate thermal engagement with the module surfaces 92, the immersion element 50 cools down and draws heat from the liquid 74 in which it is immersed. The withdrawn heat passes through the interface of the hot surfaces 94 of the modules and the abutting surface 86 of the finned heat transfer means 54 for transfer to the ambient air. The motor 108 operates at the same time that the thermoelectric modules are operated to pull air through the cover openings 74 across the fins 88 and out through the grated top 72, thereby expediting the heat transfer operation.

By virtue of the immersion of the member 50 within the liquid 74 good thermal contact is made so that the liquid can be chilled rapidly and with minimum power.

In the event that the liquid is to be heated all that is required is to reverse the receptacle 134 so that the prongs 102 and 104 are disposed in the openings 136 and 134, respectively. This action causes the surfaces 94 of the thermoelectric modules to cool while the surfaces 92 heat up. The heat produced at surfaces 92 is conducted by immersion element 50 into the liquid 74.

It must be pointed out at this juncture that switch means can be provided to reverse the direct current provided to the thermoelectric modules in lieu of the reversible plug shown herein. Moreover, while the preferred embodiment of this invention includes a fan, such a construction is not mandatory.

Without further elaboration the foregoing will so fully illustrate my invention so that others may, by applying current or future acknowledge, readily adapt the same for use under various conditions of service.

What is claimed as the invention is:

1. A portable container for cooling or heating a liquid stored therein, comprising a hollow body and a releasable securable lid assembly therefor, said body being hollow and defining a liquid-receiving chamber therein and including a threaded mouth to said chamber, said lid assembly including threads for releasable engagement with the threads of said mouth to seal said chamber, first relatively narrow, elongated, thermally conductive immersion means, said immersion means occupying a small portion of the liquid-receiving chamber and being mounted on said lid and extending downward therefrom for substantially the full depth of said chamber for immersion in any liquid held therein, thermoelectric means of the Peltier type and second thermally conductive means, said thermoelectric means having a pair of thermal surfaces, one of said surfaces in intimate thermal engagement with said first thermally conductive immersion means and the other of said surfaces in intimate thermal engagement with said second thermally conductive means, and electrical connecting means for connecting said thermoelectric means to direct current in a manner such that the polarity applied to said thermoelectric means can be selectively reversed so that said surfaces can be made either hot or cold as desired.

2. The portable liquid container of claim 1 wherein said second thermally conductive means comprises a plurality of fins.

3. The portable container of claim 2 additionally comprising fan means located over said fins.

4. The portable container of claim 3 wherein said fins and fan are mounted within a housing disposed over said lid means and secured thereto.

5. The portable container of claim 4 wherein said electrical connecting means comprises a pair of electrical contacts fixedly mounted on said lid assembly, with each of said contacts connected to a respective one of said thermoelectric surfaces, and an electrical cord terminating at one end in a pair of contacts, each of which is arranged for releasable securement to either of the contact of said lid assembly.

6. The portable container of claim 5 wherein the contacts mounted on said cord are located within a female receptacle and wherein the contacts on said lid assembly comprise a pair of prongs for reversible releasable location within said female receptacle.

* * * * *